US006116357A

United States Patent [19]

Wagoner et al.

[11] Patent Number: 6,116,357

[45] Date of Patent: Sep. 12, 2000

[54] ROCK DRILL BIT WITH BACK-REAMING PROTECTION

[75] Inventors: Robert Wagoner; Roger Didericksen, both of Ponca City, Okla.; William M. Conn, Newton, Kans.; Peter Thomas Cariveau, Ponca City, Okla.

[73] Assignee: Smith International, Inc., Houston, Tex.

[21] Appl. No.: 08/925,700

[22] Filed: Sep. 9, 1997

Related U.S. Application Data

[60] Provisional application No. 60/025,858, Sep. 9, 1996, and provisional application No. 60/051,373, Jul. 1, 1997.

[51] Int. Cl.[7] ..... E21B 10/18; E21B 10/22

[52] U.S. Cl. ..... 175/228; 175/340; 175/374; 175/406; 175/401

[58] Field of Search ..... 175/340, 339, 175/366, 367, 371, 227, 228, 374, 406, 401, 331; 76/108.2

[56] References Cited

U.S. PATENT DOCUMENTS

| | | | |
|---|---|---|---|
| Re. 32,495 | 9/1987 | Coates | 175/339 |
| 1,909,128 | 5/1933 | Scott et al. . | |
| 2,807,444 | 9/1957 | Reifschneider | 175/339 |
| 3,007,751 | 11/1961 | Eenink | 308/157 |
| 3,230,019 | 1/1966 | Kotch et al. | 308/8.2 |
| 3,230,020 | 1/1966 | Gilbert et al. | 308/8.2 |
| 3,299,973 | 1/1967 | Swart et al. | 175/371 |
| 3,463,270 | 8/1969 | Lundstrom et al. | 184/39 |
| 3,476,195 | 11/1969 | Galle | 175/228 |
| 3,719,241 | 3/1973 | Bell | 175/228 |
| 3,721,306 | 3/1973 | Sartor | 175/228 |
| 3,735,825 | 5/1973 | Keller | 175/228 |
| 3,739,864 | 6/1973 | Cason, Jr. et al. | 175/228 |
| 3,744,580 | 7/1973 | Crow | 175/228 |
| 3,841,422 | 10/1974 | Crow | 175/229 |
| 3,844,364 | 10/1974 | Crow | 175/228 |
| 3,847,234 | 11/1974 | Schumacher, Jr. et al. | 175/228 |
| 3,866,695 | 2/1975 | Jackson | 175/228 |
| 3,917,028 | 11/1975 | Garner | 184/6.14 |
| 4,012,238 | 3/1977 | Scales | 175/374 |
| 4,014,595 | 3/1977 | Dolezal | 308/8.2 |
| 4,019,785 | 4/1977 | Stinson et al. | 308/8.2 |
| 4,055,225 | 10/1977 | Millsapps | 175/228 |
| 4,102,419 | 7/1978 | Klima | 175/371 |
| 4,199,856 | 4/1980 | Farrow et al. | 29/454 |
| 4,274,498 | 6/1981 | Penny | 175/228 |
| 4,276,946 | 7/1981 | Millsapps, Jr. | 175/228 |
| 4,284,151 | 8/1981 | Levefelt | 175/227 |
| 4,372,624 | 2/1983 | Neilson | 384/94 |
| 4,386,667 | 6/1983 | Millsapps, Jr. | 175/228 |

(List continued on next page.)

FOREIGN PATENT DOCUMENTS

| | | | |
|---|---|---|---|
| 1030530 | 7/1983 | Russian Federation | 175/331 |
| 1305295 | 4/1987 | Russian Federation | 175/331 |
| 1357532 | 12/1987 | Russian Federation | 175/228 |

OTHER PUBLICATIONS

Smith Tool; Feature Bulletin; Feature Leg Back Protection; Exhibits 2–6; date: prior to filing of present application.

Sandvik Rock Tools; Raise Boring Equipment; Exhibits 7A and 7B; date: prior to filing of present application.

*Primary Examiner*—Hoang Dang

*Attorney, Agent, or Firm*—Conley, Rose & Tayon, P.C.

[57] ABSTRACT

A drill bit for boring a bore hole in an earthen formation comprises: a bit body having a pin end, a cutting end and a longitudinal bit axis and including at least two legs extending from the cutting end, each of the legs including a bearing that rotatably supports a cutter cone. The bit body further includes a fluid flow system, including a flowway in said pin end that is in fluid communication with at least one exit port in the cutting end, the exit port being defined by a nozzle boss and disposed adjacent one of the legs. Each of the legs includes a leading side surface, a trailing side surface, and a center panel, and at least one of said legs is asymmetric such that its trailing side surface is larger than its leading side surface. The present bit can also include a lubricant system that has its opening in the trailing side of the leg, and can further include various wear resistant coatings and inserts on its surface.

41 Claims, 7 Drawing Sheets

U.S. PATENT DOCUMENTS

| | | | |
|---|---|---|---|
| 4,386,668 | 6/1983 | Parish | 175/228 |
| 4,390,072 | 6/1983 | Phelan | 175/229 |
| 4,399,878 | 8/1983 | Karlsson et al. | 175/227 |
| 4,414,734 | 11/1983 | Atkinson | 76/108.2 |
| 4,428,442 | 1/1984 | Steinke | 175/228 |
| 4,428,687 | 1/1984 | Zahradnik | 384/94 |
| 4,453,836 | 6/1984 | Klima | 384/94 |
| 4,512,669 | 4/1985 | Moore | 384/93 |
| 4,513,829 | 4/1985 | Coates | 175/339 |
| 4,577,705 | 3/1986 | Cross | 175/228 |
| 4,591,008 | 5/1986 | Oliver | 175/227 |
| 4,593,775 | 6/1986 | Chaney et al. | 175/228 |
| 4,597,455 | 7/1986 | Walters et al. | 175/228 |
| 4,793,719 | 12/1988 | Crockett et al. | 384/92 |
| 4,981,182 | 1/1991 | Dysart | 175/71 |
| 4,989,680 | 2/1991 | Deane et al. | 175/340 |
| 5,027,911 | 7/1991 | Dysart | 175/57 |
| 5,148,879 | 9/1992 | Hopper | 175/371 |
| 5,161,898 | 11/1992 | Drake | 384/95 |
| 5,415,243 | 5/1995 | Lyon et al. | 175/331 |
| 5,441,120 | 8/1995 | Dysart | 175/228 |

ROCK DRILL BIT WITH BACK-REAMING PROTECTION

CROSS-REFERENCE TO RELATED APPLICATIONS

The present application claims the benefit of U.S. Provisional Application Ser. No. 60/025,858, filed Sep. 9, 1996, entitled Improved Rock Drill Bit, which is incorporated herein by reference, and of U.S. Provisional Application Ser. No. 60/051,373, filed Jul. 1, 1997, and entitled Protected Lubricant Reservoir for Sealed Bearing Earth Boring Drill Bit.

STATEMENT REGARDING FEDERALLY SPONSORED RESEARCH OR DEVELOPMENT

Not applicable.

BACKGROUND OF THE INVENTION

The invention relates to an improved rock drill bit for boring a bore hole in an earthen formation and more particularly to a rock drill bit adapted for improved protection of its components during operation in rock formations, and still more particularly to a rock drill bit adapted for improved protection of its components during back-reaming operations.

More specifically, drill bits are generally known, and fall into at least two categories. Drill bits used for drilling petroleum wells and drill bits used in the mining industry are both well known in the art. While these two types of bits superficially resemble each other, the parameters that affect the operation of each are completely different. Petroleum drill bits typically use a viscous, heavy drilling fluid (mud) to flush the cuttings from the vicinity of the bit and carry them out of the hole, whereas mining bits typically use compressed air to achieve the same purpose. Petroleum bits typically drill deep holes, on the order of thousands of feet, and each bit typically drills several hundreds or thousands of feet before being removed from the hole. In contrast, mining bits are used to drill relatively shallow holes, typically only 30–50 feet deep, and must be withdrawn from each shallow hole before being shifted to the next hole, resulting in severe backreaming wear. For these reasons, the factors that affect the design of mining bits are very different from those that affect the design of petroleum bits.

For instance, the viscosity and density of the drilling mud makes it possible to flush the cuttings from the hole even at relatively low fluid velocities. The air used to flush cuttings from mining holes, in contrast, is much less viscous and dense and therefore must maintain a rapid velocity in order to successfully remove the rock chips. This means that the cross-sectional area through which the air flows at each point along the annulus from the bit to the surface must be carefully maintained within a given range. Similarly, the rapid flow of air across and around a rock bit greatly increases the erosive effect of the cuttings, particularly on the leading portions of the bit.

Furthermore, rock bits are now being developed with sealed lubrication systems that allow easier rotation of the bit parts. These sealed lubrication systems typically comprise a lubricant reservoir in fluid communication with the bearings. In many cases, the reservoir is created by drilling a cavity into the bit leg. Access to the reservoir is through the opening of this cavity, which can then be sealed with a conventional plug or vented plug. These sealed lubrication systems are particularly vulnerable to erosion of the bit body, as any breach of the sealed system can result in the ingress of cuttings and/or particles into the bearings, causing bit failure. Heretofore, the reservoir opening has been located on the main outer face of each leg, with the result that the reservoir plugs and the walls of the reservoir itself are vulnerable to wear on the leg.

Hence it is desirable to provide a mining bit that provides increased protection for the reservoir and its plug and opening. It is further desired to provide a bit that is capable of withstanding wear on its shoulders and legs during backreaming or as the bit is being withdrawn from a hole.

BRIEF DESCRIPTION OF THE DRAWINGS

For a detailed description of the preferred embodiment of the invention, reference will now be made to the accompanying drawings wherein.

DESCRIPTION OF THE PREFERRED EMBODIMENTS

Figure 1:
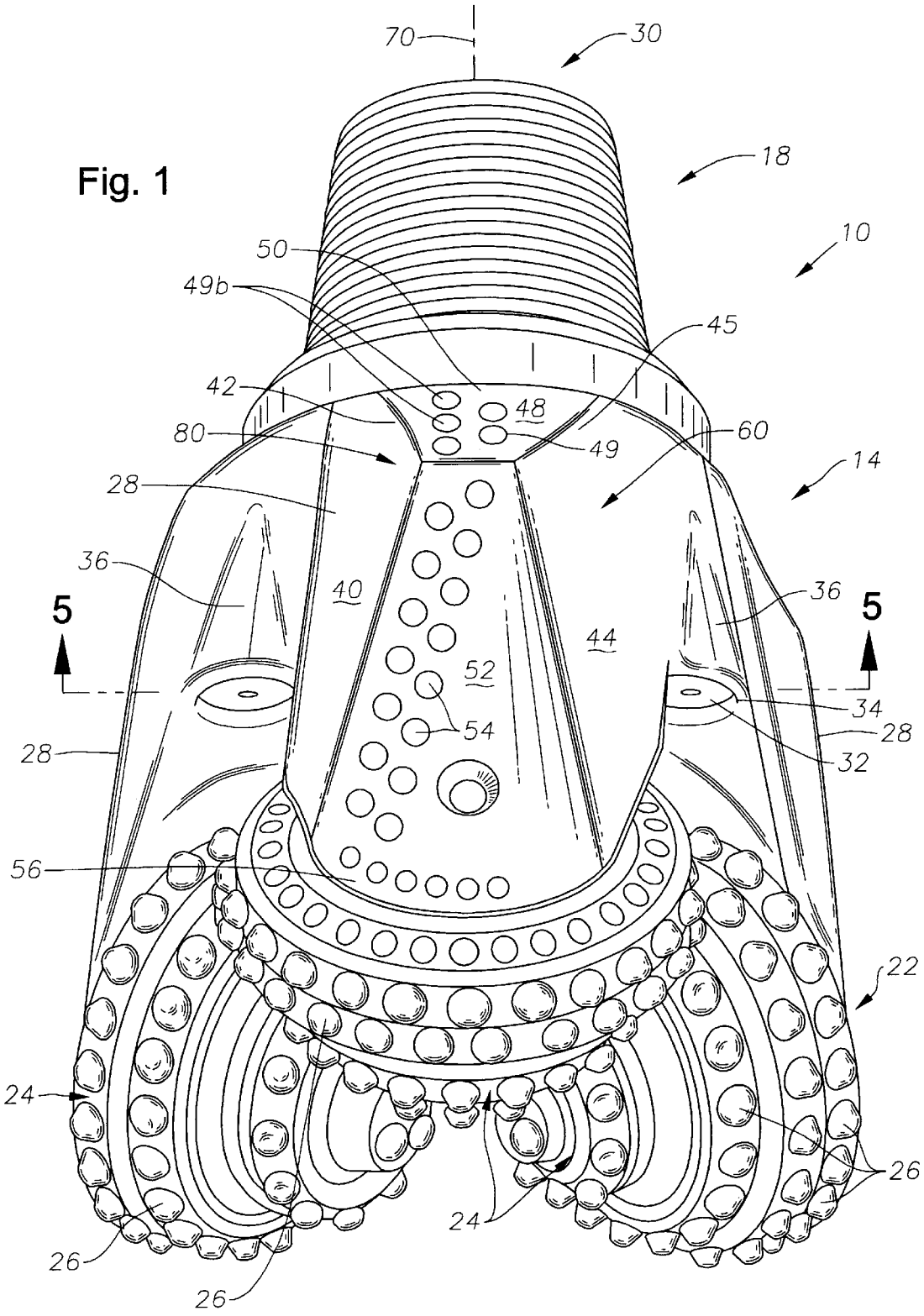
FIG. 1 is an isometric view of a roller cone drill bit of the present invention.

The presently preferred embodiments of the invention are shown in the above-identified figures and described in detail below. In describing the preferred embodiments, like or identical reference numerals are used to identify common or similar elements. The figures are not necessarily to scale and certain features and certain views of the figures may be shown exaggerated in scale or in schematic form in the interest of clarity and conciseness.

Referring initially to FIG. 1, a rotary cone rock bit 10 is shown having a bit body 14 with an upper or pin end 18 adapted for connection with a drill string of a drilling rig (not shown) and a lower, or cutting end 22 for cutting a bore hole in an earthen formation. The cutting end 22 of the bit body 14 is shown including three rotating cutter cones 24, each having a multitude of protruding cutting elements 26 for engaging the earthen formation and boring the bore hole as the bit is rotated in a clockwise direction. The cutting elements 26 may be tungsten carbide inserts or other suitable types of inserts or cutting elements. Each cutter cone 24 is rotatably mounted upon a leg portion 28 of the bit body 14, respectively.

The leg portions 28 are individually formed by forging and machining processes. Thereafter, each cutter cone 24 is mounted upon a cantilevered journal portion 29 (FIGS. 2 and 3) of one of the legs 28, and the legs 28 are connected by conventional methods, such as by welding. It should be understood that the bit body 14 may be formed with two or over three cutter cone/leg pairs as is presently, or may in the future be, compatible for use with a rotary cone rock bit 10.

Figure 5:
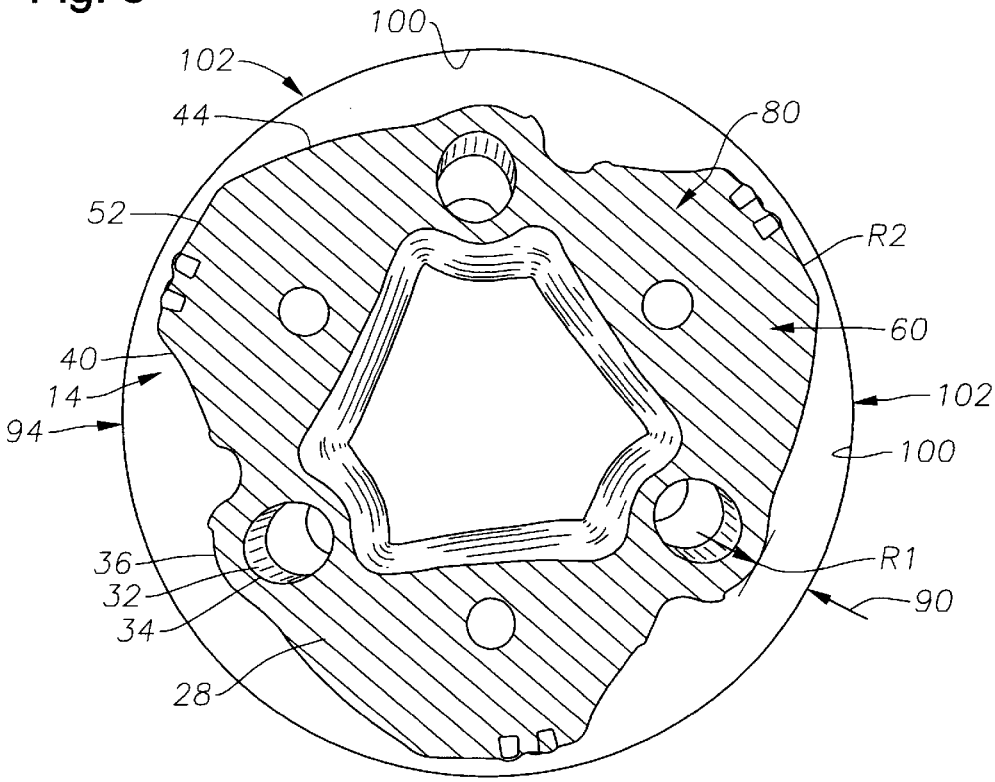
FIG. 5 is a cross-sectional view at plane 5—5 in FIG. 1 showing the roller cone bit in a bore hole.

A flowway 30 is formed within the bit body 14 for allowing the flow of drilling fluid, such as drilling "mud," water or compressed gas, from the surface through the pin end 18 of the bit body 14 into the bore hole (not shown) through one or more nozzles 32. Each nozzle 32 extends between the flowway 30 and a port 34 in one of the legs 28 (FIG. 5). A nozzle boss 36 is disposed on each leg 28 about and above the nozzle port 34. Drilling fluid may thus be directed through the drill bit 10 to cool the drill bit 10 and transport rock cuttings and earthen debris up and out of the bore hole.

Each leg 28 of the bit body includes a leading side 40, a trailing side 44, a shoulder 48 and a center panel 52. As the bit 10 is rotated during operation, the leading side 40 of each leg 28 leads the rotational path of the leg 28, followed by the shoulder 48 and center panel 52, which are followed by the trailing side 44. In the preferred embodiment, the nozzle 32 extends through the trailing side 40 of the leg 28, upon which the nozzle boss 36 is disposed, providing enhanced protection of the nozzle 32 and nozzle boss 36 during use of the drill bit 10, as will be described further below.

Figure 2:
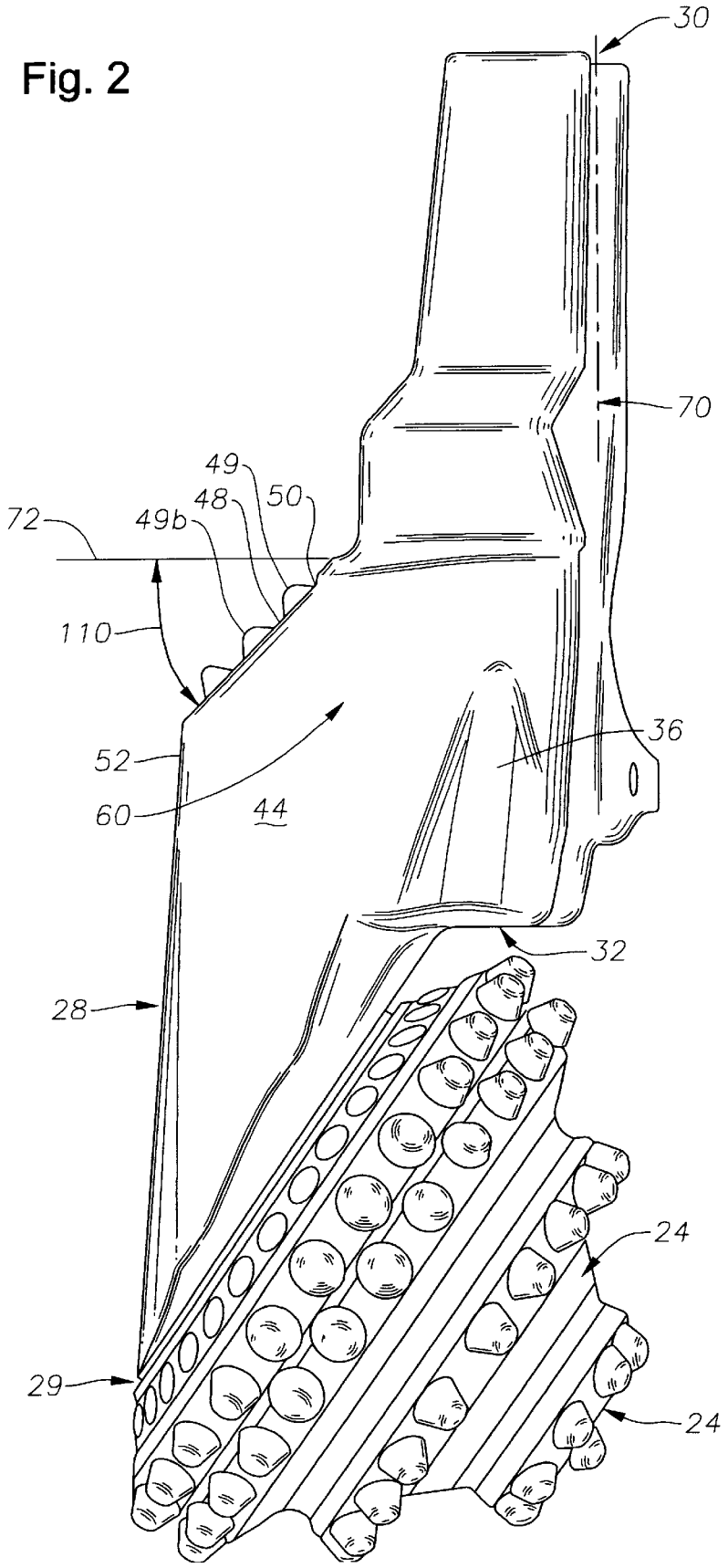
FIG. 2 is a side view of one leg of a roller cone drill bit having a first embodiment of a nozzle boss of the present invention.
Figure 4:
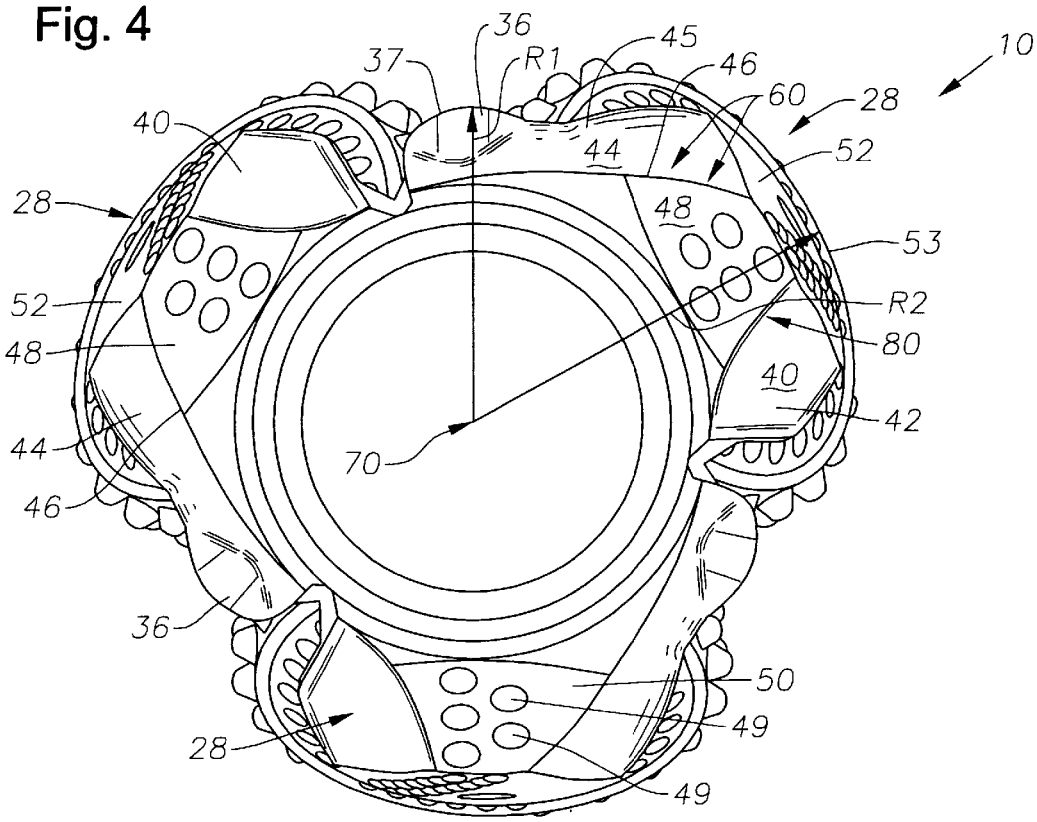
FIG. 4 is a top view of the roller cone bit of FIG. 1.

As shown in FIGS. 2 and 4, an upper trailing mass 60 of the leg 28 extends generally between the nozzle boss 36 and the center panel 52 and shoulder 48 to block, and thus protect, the nozzle boss 36 and nozzle 32 from contact with the bore hole wall and rock cuttings and debris during use. During forging of the leg 28, material is added to the upper trailing mass 60, which causes the center panel 52 of the leg 28 to extend radially outwardly from the bit centerline 70 substantially farther than the corresponding radial extension of the nozzle boss 36. For example, as shown in FIG. 4, the radius R1 from bit centerline 70 to the edge 37 of the nozzle boss 36 is substantially smaller than the radius R2 from bit centerline 70 to the outer surface 53 of the center panel 52. The nozzle boss 36 is thus set back or inboard relative to the center panel 52. Material may be added to the upper trailing mass 60 to cause the trailing side surface 45 to take a convex shape, as shown by convex edge 46 in FIG. 4, though such configuration is not necessary. Thus, as the bit 10 rotates clockwise in the bore hole as viewed in FIG. 4, the nozzle boss 36 is blocked, or protected, from contact with the bore hole wall (not shown) as well as rock cuttings and other debris in the bore hole by the leading side 40 and center panel 52 adjacent the protruding upper trailing mass 60 of the leg 28.

The addition of material to the upper trailing mass 60 of the leg 28 during forging warrants the subtraction of material from elsewhere on the leg 28 to ensure a sufficient annular bore hole clearance. If material is not removed from the leg 28 to compensate for the addition of material to the upper trailing mass 60, the size or clearance of the annular space between the assembled bit body 14 and the bore hole wall will be lessened. This result is undesirable for at least two reasons: it will inhibit the upward flow and removal of drilling fluid, rock cuttings and other debris adjacent the bit, and it will cause the velocity of the moving fluid and material to increase significantly, as further explained below. Thus, in the embodiment described above, more of the mass of the bit body lies between said trailing side surface 44 and a plane through the bit axis 70 and the center of center panel 52 than lies between said leading side 40 surface and the same plane.

Figure 6:
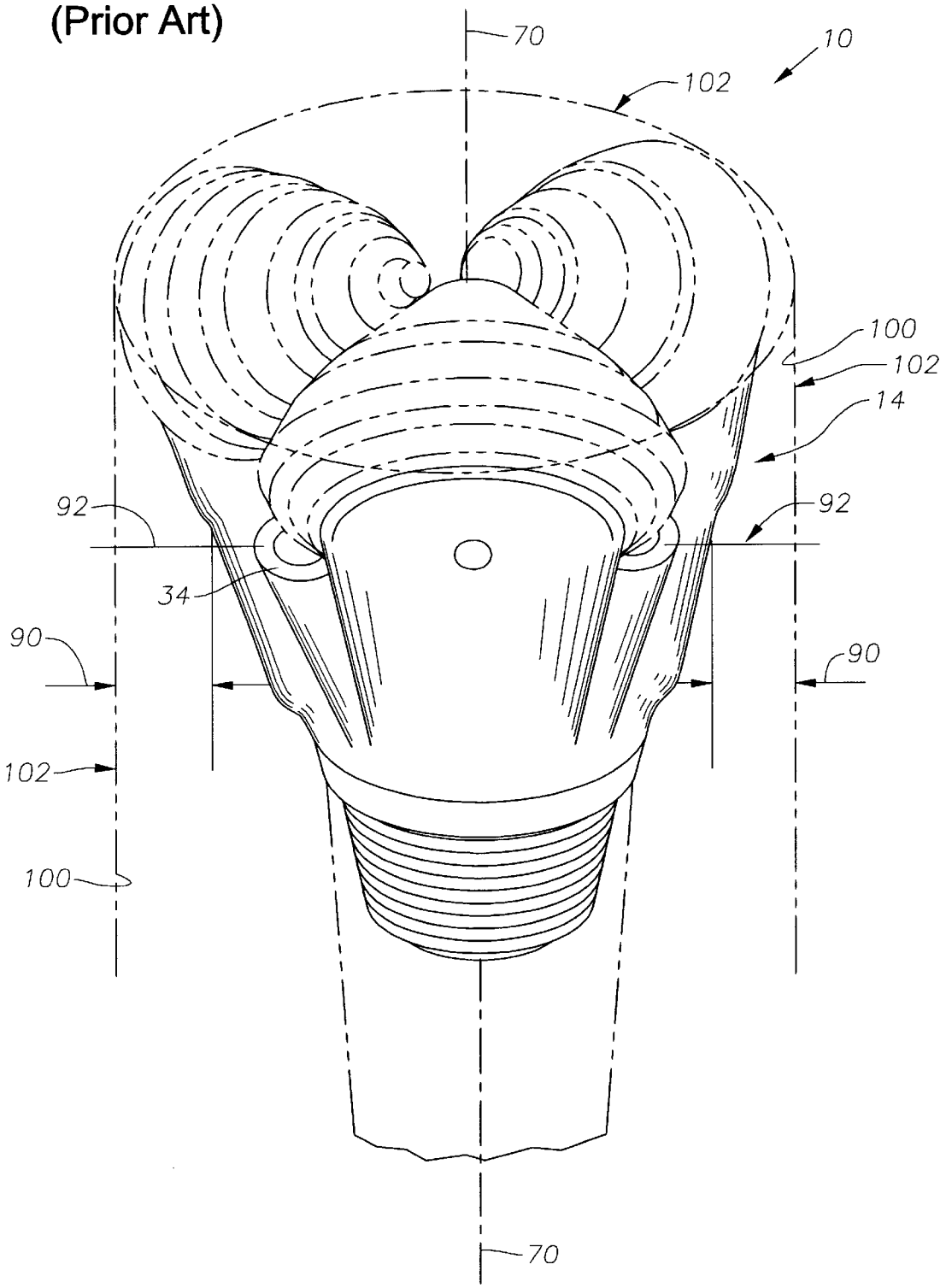
Fig. 6 (Prior Art)
FIG. 6 is a perspective view of a typical prior art mining bit.

It is known in the prior art as depicted in FIG. 6, that the annulus 90 between the wall 100 of the bore hole 102 and the bit body 14 must be of a sufficient size to allow for adequate passage of drilling fluid and materials carried thereby, or "hole cleaning," as disclosed in U.S. Pat. No. 4,513,829 to Coates, which is hereby incorporated by reference in its entirety. The annulus 90 is conventionally measured from the bit body 14 through a plane 92 perpendicular to the bit centerline 70 approximately at the level of the nozzle port 34. It is recognized in the art that an annulus 90 of at least 35 percent of the entire cross-sectional area formed by the bore hole 102 through plane 92 is sufficient.

It is also known that the upward velocity of the exiting drilling fluid and material carried thereby increases as the area of the annulus 90 decreases. Such velocities can reach sand-blast velocity levels and are capable of causing significant erosive damage to a drill bit. Thus, the smaller the annulus 90, the greater risk of damage to drill bit 10 from high velocity drilling fluid, rock cuttings and other material.

It has been discovered in connection with the present invention that an annulus 90 of 37 to 40 percent of the entire cross sectional area formed by the bore hole 102 through plane 92 provides optimal clearance for effective hole cleaning at non-destructive velocities (FIG. 5). To achieve a sufficient or optimal clearance of annulus 90 with drill bit 10 having legs 28 with built-up upper trailing masses 60, sufficient material from elsewhere in the bit body 14 must be removed. Material may be removed during forging from an upper leading mass 80 of each leg 28 to compensate for the increased size of the upper trailing mass 60, as shown in FIGS. 4 and 5. As the size of the upper trailing mass 60 is increased, the size of the upper leading mass 80 of the leg 28 may be decreased. Material may be removed from the upper leading mass 80 such that the surface 42 of the leading side 40 takes a concave shape, although such configuration is not necessary. The bit body 14, thus takes an asymmetric configuration as viewed in cross section.

Figure 7:
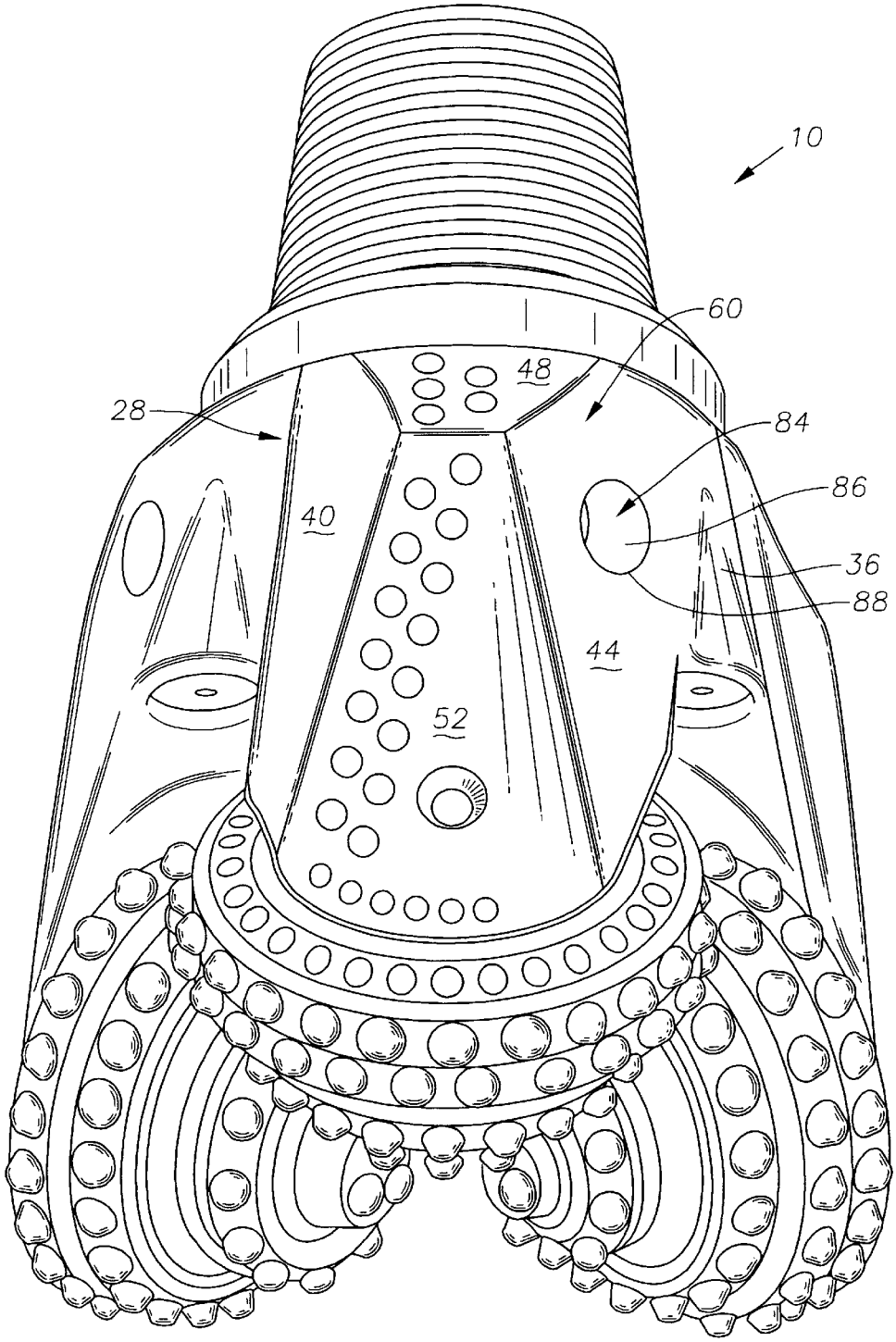
FIG. 7 is an isometric view of a sealed bearing roller cone drill bit of the present invention.

Referring now to FIG. 7, in one embodiment of the invention, the drill bit 10 may be a sealed bearing bit, having a sealed bearing/lubrication system for each cutter cone 24. As known in the art, a sealed bearing system requires a cavity, or reservoir, 84 disposed in each leg 28 for retaining various system components. As shown in FIG. 7, the cavity 84 may be formed into the upper trailing mass 60 of the leg 28. The upper trailing mass 60 provides substantial protection for the cavity 84 recessed therein. Because of the size of the upper trailing mass 60, the cavity 84 can be machined into the leg 28 with only one of its ends 86 terminating in an opening 88. The remainder of the cavity 84 is completely surrounded by the body material of the upper trailing mass 60, forming a "blind hole." This added protection about the cavity 84 will assist in preventing damage to the cavity 84 during use of the drill bit 10.

Figure 3:
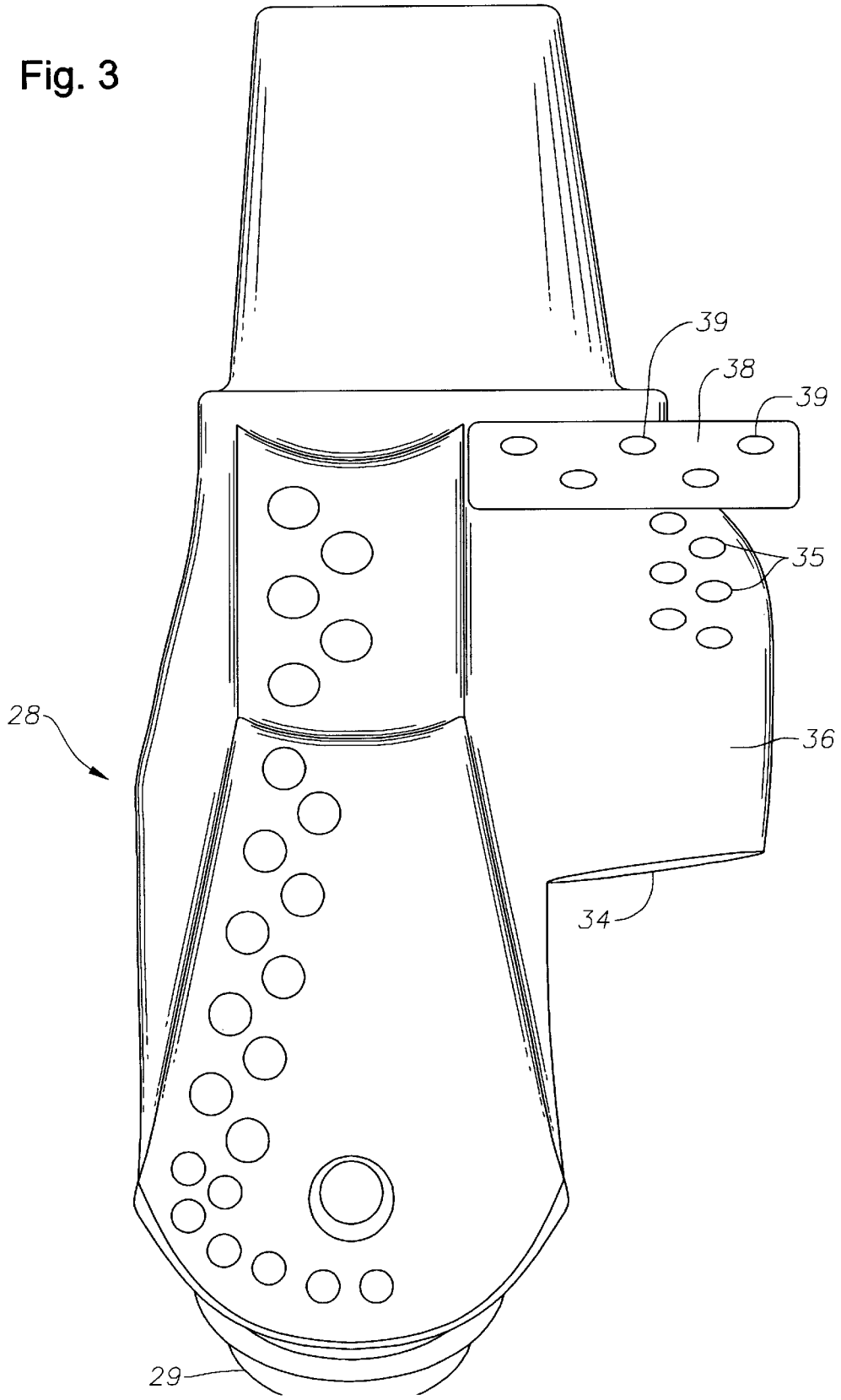
FIG. 3 is a front elevation view of one leg of a roller cone drill bit having a second embodiment of a nozzle boss of the present invention.
Figure 8:
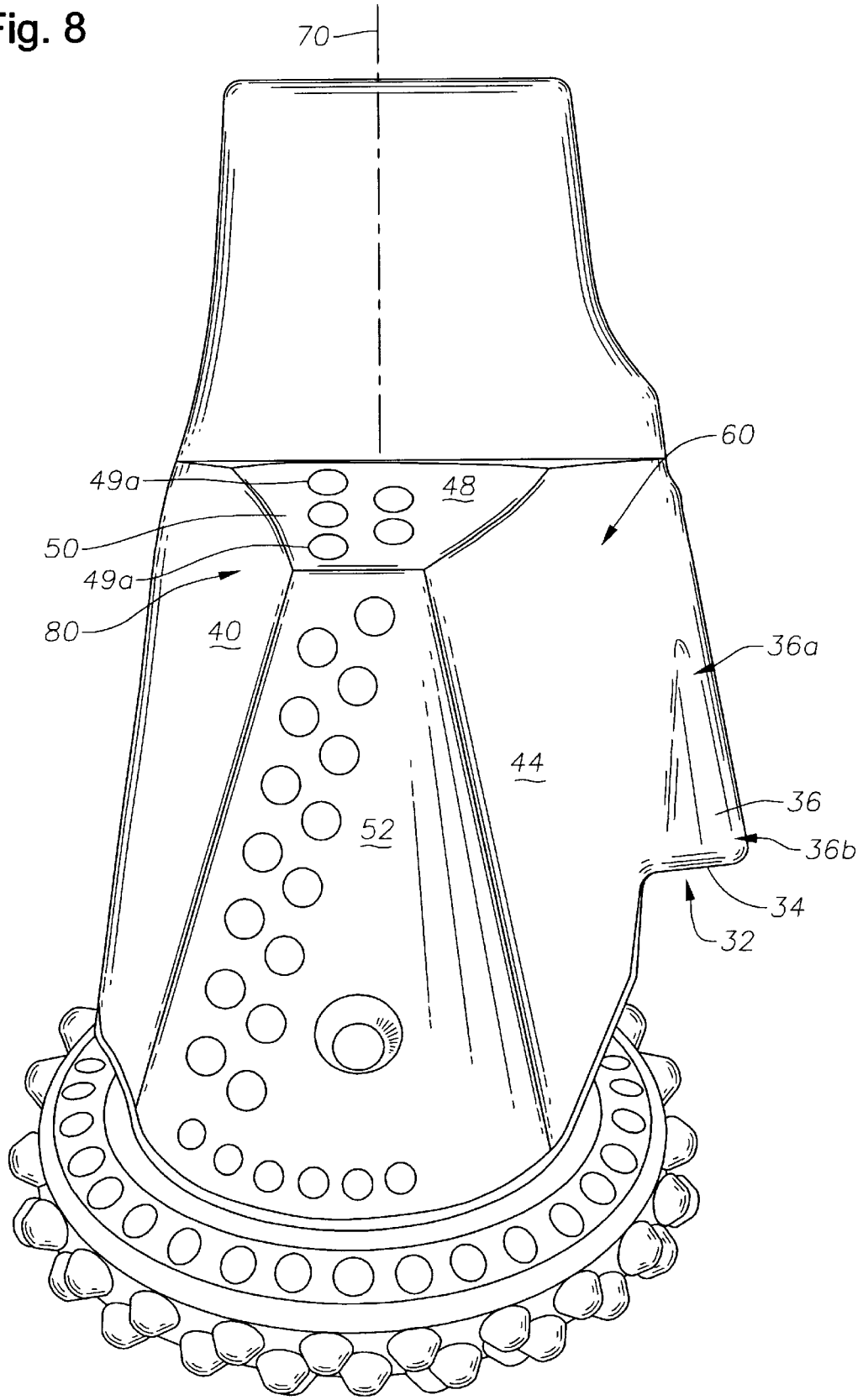
FIG. 8 is a front view of one leg of the roller cone drill bit of FIG. 1.

Referring to FIG. 8, the nozzle boss 36 may be formed in a streamlined shape, sloping outwardly from the bit centerline 70 from the upper portion **36*a* to the lower portion 36*b* of the nozzle boss 36, reducing the protruding surface area of the nozzle boss 36 and minimizing contact with the bore hole wall (not shown), and rock cuttings and debris in the bore hole. Further, the nozzle boss 36 may be formed with a sufficient thickness to be capable of supporting a hard wear resistant material, such as inserts 35, for added protection (FIG. 3**). It will be understood that the term "hard wear resistant material" as used herein refers to any material that has strength or wear characteristics equal to or better than steel, and that can be affixed onto, or formed into, the drill bit, including, but not limited to inserts such as are well known in the art.

Another embodiment illustrated in FIG. 3 includes a nozzle boss guard 38 disposed upon leg 28 above the nozzle boss 36 proximate to pin end 18 of the bit body 14 to protect and shield the nozzle boss 36 and nozzle 32 from contact with the bore hole wall and rock fragments and debris in the bore hole. Nozzle boss guard 38 is protected with a wear resistant material and may extend radially outwardly from the bit centerline (not shown) farther than the nozzle boss 36. Nozzle boss guard 38 is preferably formed having a thickness sufficient to hold inserts 39 to further protect the nozzle boss guard 38 and nozzle boss 36 from excessive abrasive and erosive wear. Such inserts 39, which may be tungsten carbide or any other type of suitable insert, will enhance the longevity of the nozzle boss guard 38. The nozzle boss guard 38 may be constructed of steel, or other suitable material, and may be coupled to the leg 28 with conventional techniques, such as by welding.

As best shown in FIGS. 1 and 2, in another aspect of the invention, the outer surface 50 of the shoulder 48 is capable of carrying a plurality of inserts 49 to protect the bit body 14 from excessive abrasive and erosive wear during use. Inserts 49 can also be disposed on the surface 50 for engaging and grinding loose rock in the well bore above the bit 10 during back-reaming or extraction of the drill bit, as disclosed in U.S. Pat. No. 5,415,243 to Lyon et al., which is incorporated herein by reference in its entirety. Any number of the inserts 49 may be set flush with the outer surface 50, such as "flat top" tungsten carbide inserts 49*a* (FIG. 8), or disposed upon the shoulder 48 to protrude from the surface 50, such as domed shaped tungsten carbide inserts 49*b*. Other types of inserts, such as chisel shaped or conical shaped inserts, that are or may be compatible for use with rock bits may likewise be used as inserts 49.

Referring to FIG. 2, the inserts 49 may be disposed at a particular angle in the bore hole to optimize their ability to engage and grind, or cut, rock during back-reaming operations. Typically, the inserts 49 are mounted upon the shoulder 48 such that the central axes of inserts 49 are perpendicular to the surface 50 of the shoulder 48. It has been discovered that an angular disposition 110 of the shoulder 48 in the bore hole relative to plane 72, which is perpendicular to the central axis 70 of the drill bit 10, of less than about 10 degrees provides an insufficient cutting angle for the inserts 49. In addition, an angular disposition 110 of shoulder 48 of less than about 10 degrees provides inadequate mounting space on the surface 50 of the shoulder 48 for a sufficient quantity of inserts 49 for effective back-reaming, such as, for example, five inserts 49. Further, an angular disposition 110 of greater than about 60 degrees can cause the bit 10 to wedge and become stuck in the bore hole when the bit 10 is being extracted. Thus, the effective range of angular disposition 110 of shoulder 48 is about 10–60 degrees. It has further been discovered that the optimum angular disposition 110 of the shoulder 48 for effective backreaming is about 45 degrees.

As shown in FIG. 1, the center panel 52 of the leg 28 may carry a plurality of inserts 54 along its length and upon a shirttail portion 56 to help protect the center panel 52 from excessive abrasive and erosive wear during drilling and back-reaming operations. The inserts 54 may be any of the types previously described and may be flush mounted or protruding from the panel 52.

The aforementioned features of the present invention are useful during drilling operations and particularly advantageous for preventing damage to the bit body 14 and for preserving bit longevity during back-reaming operations. Further, it should be understood that while the invention has been described with respect to a rotary cone rock bit, the invention may likewise be used with other the types of drilling bits, such as, for example, milled tooth bits.

While preferred embodiments of the present invention have been shown and described, modifications thereof can be made by one skilled in the art without departing from the spirit or teachings of this invention. The embodiments described herein are exemplary only and are not limiting. Many variations and modifications of this system and apparatus are possible and are within the scope of the invention. Accordingly, the scope of protection is not limited to the embodiments described herein.

What is claimed is:

1. A drill bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, and a center panel;

at least one of said legs being asymmetric such that its trailing side surface is larger than its leading side surface; and a lubrication system in at least one of said legs, said lubrication system comprising a lubricant reservoir in fluid communication with said bearing, said reservoir comprising a cavity formed in said leg and having a reservoir installation opening in said trailing side surface of said leg.

2. A drill bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, and a center panel;

at least one of said legs being asymmetric such that its trailing side surface is larger than its leading side surface; and a hard wear resistant material on said nozzle boss.

3. The bit according to claim 2, wherein said hard wear resistant material comprises wear resistant inserts.

4. A drill bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, and a center panel;

at least one of said legs being asymmetric such that its trailing side surface is larger than its leading side surface; and a nozzle boss guard on said one of said legs above said nozzle boss.

5. The bit according to claim 4, further including a hard wear resistant material on said nozzle boss guard.

6. A drill bit for boring a bore hole in an earthen formation, comprising:

a bit body having a pin end, a cutting end and a longitudinal axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel, said center panel extending radially outwardly from said longitudinal axis farther than the corresponding radial extension of said nozzle boss and said shoulder defining an angle with respect to a plane perpendicular to said bit axis, said angle being between 10 and 60 degrees; and said bit body further including a lubrication system in at least one of said legs, said lubrication system comprising a lubricant reservoir in fluid communication with said bearing, said reservoir comprising a cavity formed in said leg and having a reservoir installation opening in said trailing side surface of said leg.

7. The bit according to claim 6, further including a plurality of wear resistant inserts on said shoulder.

8. The bit according to claim 6 wherein each of said legs is asymmetric such that its trailing side surface is larger than its leading side surface.

9. The bit according to claim 6 wherein said trailing side surface above said exit port is convex.

10. The bit according to claim 6 wherein said leading side surface is concave.

11. A drill bit for boring a bore hole in an earthen formation, comprising:

a bit body having a pin end, a cutting end and a longitudinal axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel, said center panel extending radially outwardly from said longitudinal axis farther than the corresponding radial extension of said nozzle boss and said shoulder defining an angle with respect to a plane perpendicular to said bit axis, said angle being between 10 and 60 degrees;

said bit body further including a lubrication system in at least one of said legs, said lubrication system comprising a lubricant reservoir in fluid communication with said bearing, said reservoir comprising a cavity formed in said leg and having an opening in said trailing side surface of said leg; and a plurality of wear resistant inserts on said nozzle boss.

12. A drill bit for boring a bore hole in an earthen formation, comprising:

a bit body having a pin end, a cutting end and a longitudinal axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel, said center panel extending radially outwardly from said longitudinal axis farther than the corresponding radial extension of said nozzle boss and said shoulder defining an angle with respect to a plane perpendicular to said bit axis, said angle being between 10 and 60 degrees;

said bit body further including a lubrication system in at least one of said legs, said lubrication system comprising a lubricant reservoir in fluid communication with said bearing, said reservoir comprising a cavity formed in said leg and having an opening in said trailing side surface of said leg; and a nozzle boss guard on said one of said legs above said nozzle boss.

13. The bit according to claim 12, further including a plurality of wear resistant inserts on said nozzle boss guard.

14. A bit for boring a bore hole in an earthen formation, comprising:

a bit body having a pin end, a cutting end and a longitudinal bit axis and including at least two legs extending from said cutting end, each of said legs including a bearing and rotatably supporting a cutter cone on said bearing, said bit body further including a fluid flow system, including a flowway in said pin end in fluid communication with at least one exit port being defined by a nozzle boss and disposed adjacent one of said legs;

each of said legs including a leading side surface, a trailing side surface, a shoulder and a center panel; and said bit body further including a lubrication system in said one of said legs, said lubrication system comprising a lubricant reservoir in fluid communication with said bearing, said reservoir comprising a cavity formed in said leg and having a reservoir installation opening in said trailing side surface of said one of said legs.

15. The bit according to claim 14 wherein at least one of said legs is asymmetric such that its trailing side surface is larger than its leading side surface.

16. The bit according to claim 15 wherein said bit body includes a lubrication system in said one of said legs, said lubrication system comprising a lubricant reservoir in fluid communication with a bearing, said reservoir comprising a cavity having an opening in said larger trailing side surface.

17. The bit according to claim 15 wherein each of said legs is asymmetric such that more of the mass of the bit body lies between its trailing side surface and a plane through the bit axis and the center of its center panel than lies between its leading side surface and said plane.

18. The bit according to claim 17 wherein said trailing side surface is convex.

19. The bit according to claim 17 wherein said leading side surface is concave.

20. The bit according to claim 19 wherein said center panel extends radially outwardly from said longitudinal axis farther than the corresponding radial extension of said nozzle boss.

21. The bit according to claim 17 wherein said shoulder defines an angle with respect to a plane perpendicular to said bit axis, said angle being between 10 and 60 degrees.

22. The bit according to claim 17, further including a plurality of wear resistant inserts on said shoulder.

23. A drill bit for boring a bore hole in an earthen formation, comprising:

a bit body having a pin end, a cutting end and a longitudinal bit axis and including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel;

said bit body further including a lubrication system in said one of said legs, said lubrication system comprising a lubricant reservoir in fluid communication with said bearing, said reservoir comprising a cavity formed in said leg and having an opening in said trailing side surface of said one of said legs;

each of said legs is asymmetric such that more of the mass of the bit body lies between its trailing side surface and a plane through the bit axis and the center of its center panel than lies between its leading side surface and said plane; and a plurality of wear resistant inserts on said nozzle boss.

24. A drill bit for boring a bore hole in an earthen formation, comprising:

a bit body having a pin end, a cutting end and a longitudinal bit axis and including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs;

each of said legs including a leading side surface, a trailing side surface, a shoulder and a center panel;

said bit body further including a lubrication system in said one of said legs, said lubrication system comprising a lubricant reservoir in fluid communication with said bearing, said reservoir comprising a cavity formed in said leg and having an opening in said trailing side surface of said one of said legs;

each of said legs is asymmetric such that more of the mass of the bit body lies between its trailing side surface and a plane through the bit axis and the center of its center panel than lies between its leading side surface and said plane; and a nozzle boss guard on said one of said legs above said nozzle boss.

25. The bit according to claim 24, further including a plurality of wear resistant inserts on said nozzle boss guard.

26. A drill bit for boring a bore hole in an earthen formation, comprising:

a bit body having a pin end, a cutting end and a longitudinal axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs, said nozzle boss including a plurality of wear resistant inserts thereon.

27. The bit according to claim 26, further including a nozzle boss guard on said one of said legs above said nozzle boss.

28. The bit according to claim 27, further including a plurality of wear resistant inserts on said nozzle boss guard.

29. The bit according to claim 26, wherein said wear resistant inserts are made of tungsten carbide.

30. The bit according to claim 26, wherein said wear resistant inserts protrude above the surface of said nozzle boss.

31. The bit according to claim 26, wherein said wear resistant inserts do not protrude above the surface of said nozzle boss.

32. The bit according to claim 26, wherein said wear resistant inserts include a second longitudinal axis;

the cross section of said wear resistant inserts on a plane perpendicular to said second longitudinal axis is not circular.

33. The bit according to claim 26, wherein said nozzle boss is continuously connected to said trailing surface.

34. A drill bit for boring a bore hole in an earthen formation, comprising:

a bit body having a pin end, a cutting end and a longitudinal axis and including at least two legs extending from said cutting end, each of said legs including a bearing and rotatably supporting a cutter cone on said bearing, said bit body further including a fluid flow system, including a flowway in said pin end in fluid communication with at least one exit port in said cutting end, said exit port being defined by a nozzle boss and disposed adjacent one of said legs, said nozzle boss including a nozzle boss guard on said one of said legs above said nozzle boss.

35. The bit according to claim 34, further including a wear resistant material having a hardness greater than that of steel on said nozzle boss guard.

36. The bit according to claim 35, wherein said wear resistant material is welded to said nozzle boss guard.

37. The bit according to claim 34, further including a plurality of wear resistant inserts on said nozzle boss guard.

38. The bit according to claim 37, wherein said inserts are made of tungsten carbide.

39. The bit according to claim 34, wherein said nozzle boss guard is welded to said one of said legs.

40. The bit according to claims 34, wherein said nozzle boss guard is integral with said one of said legs.

41. The bit according to claim 34, wherein the radial extension of said nozzle boss guard from said longitudinal axis is greater than the corresponding radial extension of said nozzle boss.

* * * * *